United States Patent [19]

Watson

[11] 4,110,710

[45] Aug. 29, 1978

[54] MICROWAVE BANK BRANCHING ARRANGEMENTS

[75] Inventor: Barry Kenneth Watson, Witham, England

[73] Assignee: The Marconi Company Limited, Chelmsford, England

[21] Appl. No.: 757,558

[22] Filed: Jan. 7, 1977

[30] Foreign Application Priority Data

Jan. 20, 1976 [GB] United Kingdom ..... 2223/76

[51] Int. Cl.[2] ..... H01P 5/18

[52] U.S. Cl. ..... 333/10; 179/170 HF; 333/1; 333/6; 333/17 R

[58] Field of Search ..... 333/6, 8, 9, 17 R, 10, 333/24 R, 1, 73 R; 324/77 E, 78 F; 179/170 HF

[56] References Cited

U.S. PATENT DOCUMENTS

| | | | |
|---|---|---|---|
| 2,922,123 | 1/1960 | Cohn | 333/6 X |
| 3,605,012 | 9/1971 | Kubanoff | 324/78 F |
| 3,668,564 | 6/1972 | Ren et al. | 333/6 |
| 3,851,282 | 11/1974 | Watson | 333/35 X |

*Primary Examiner*—Paul L. Gensler

*Attorney, Agent, or Firm*—Diller, Brown, Ramik & Wight

[57] ABSTRACT

A microwave band branching arrangement for successively coupling frequency sub-bands of a broad frequency band of energy has a coupler for coupling the highest sub-band of frequencies at one end of the arrangement and a series of successive couplers which are each arranged to sequentially couple frequency sub-bands of energy in an ascending order of frequency from the coupler which couples the highest frequency sub-band. By arranging that the highest frequency sub-band is coupled first, it is subjected to a lower attenuation. In further embodiments of the invention, where the arrangement is used, for example, in a repeater station, sub-bands of energy are coupled out, regenerated and amplified, and reinserted by a further coupler into the arrangement for further transmission.

8 Claims, 3 Drawing Figures

MICROWAVE BANK BRANCHING ARRANGEMENTS

Figure 1:
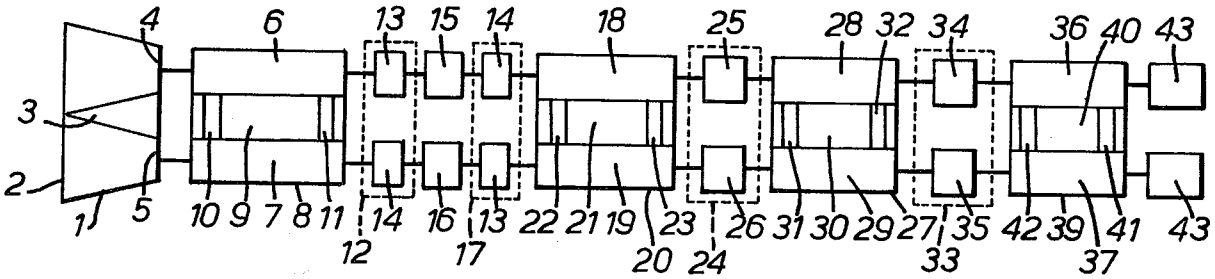

This invention relates to a microwave band branching arrangement for successively coupling energy contained in a sub-band of frequencies which is germane to energy contained in a broad band of frequencies. By the term "broad band" as used herein is meant a band of frequencies in the range 20GHz to 130GHz and sub-band frequencies have a bandwidth of the order of 40GHz.

In a prior band branching arrangement, broad band energy in a frequency range 32GHz to 110GHz is coupled by five couplers from rectangularly sectioned waveguide operating in the $TE_{10}^{\square}$ mode to semi-circularly sectioned waveguides each operating in the $TE_{01}^{\frown}$ mode, with each of the semi-circularly sectioned waveguides coupling a bandwidth, i.e. sub-band, of energy of up to 33% of the mid-band frequency. Each of the couplers are of the centre excited type with the narrow walls of the rectangular waveguide connected to the flat walls of two semi-circularly sectioned waveguides. Energy from the semi-circularly sectioned waveguides of each of the couplers is serially combined and fed to a bifurcation which transforms the two semi-circularly sectioned waveguides of an adjacent coupler into a circularly sectioned waveguide propagating the broad band of energy in a $TE_{01}^{\circ}$ mode. In the known arrangement the sub-band frequency coupling regime is such that the sub-bands are combined in an ascending order from the bifurcation. Thus, from the bifurcation the sub-bands are combined in the order 32–40GHz, 40–50GHz, 50–70GHz, 70–90GHz, and 90–110GHz.

However, the applicants have found that in a typical transmission path, energy in the forementioned highest and lowest sub-bands is attenuated the most, and further, the attenuation of the serial connection of couplers from the coupler in which the highest sub-band is transferred from the $TE_{10}^{\square}$ mode to the $TE_{01}^{\frown}$ mode to the bifurcation is of the order of 4dB. Thus, the highest frequency sub-band receives the greatest attenuation over a complete transmission path, i.e. from mode transference in a coupler at the transmitting station to mode re-transference at a receiving station having a similar band branching arrangement to that at the transmitting station, so that the highest sub-band is attenuated by the order of a total of 8dB due merely to the insertion loss in the transmitting and receiving station band branching units.

The object of the present invention is to provide a band branching unit in which the attenuation within the band branching unit of the highest frequency sub-band is substantially reduced.

According to this invention in its broadest aspect, a microwave band branching arrangement for successively coupling frequency sub-bands germane to a broad frequency band of energy includes coupler means for coupling a highest sub-band of frequencies at one end of the arrangement and a plurality of successive coupler means each arranged to sequentially couple frequency sub-bands of energy in an ascending order of frequency from the coupler means coupling said highest frequency sub-band.

Preferably the coupler means are each formed by a centre excited coupler capable of selectively transferring the broad band frequencies from two semi-circularly sectioned waveguides each operable in a $TE_{01}^{\frown}$ mode to an axially, centrally, disposed waveguide having a further different cross-section.

Conveniently, the further different cross-section is rectangular with the narrow walls thereof connected to the flat sides of the semi-circular waveguides and is capable of supporting one of the frequency sub-bands in a $TE_{10}^{\square}$ mode.

According to one aspect of this invention, a microwave band branching unit includes the sequential connection of a bifurcation for transferring $TE_{01}^{\circ}$ mode energy at one end thereof from a circularly sectioned waveguide to $TE_{01}^{\frown}$ mode energy in two semi-circularly sectioned waveguides at the other end thereof, the $TE_{01}^{\frown}$ mode energy in each of the semi-circular waveguides being in-phase opposition, a first centre excited coupler for transferring the $TE_{01}^{\frown}$ mode energy above a first predetermined frequency from the two semi-circularly sectioned waveguides to a $TE_{10}^{\square}$ mode in an axially, centrally disposed waveguide having a rectangular cross-section with the narrow walls thereof connected to the flat sides of the semi-circular waveguides, a phase shifter and a low pass filter for permitting energy below said first predetermined frequency to pass therethrough with a phase shift governed by the phase shifter and arranged to reflect $TE_{01}^{\frown}$ mode energy above said predetermined frequency such that the $TE_{01}^{\frown}$ mode energy above said predetermined frequency is reflected with an in-phase relationship so that it is capable of being coupled by the rectangularly sectioned waveguide, a further phase shifter for restoring the phase opposition relationship between the $TE_{01}^{\frown}$ mode energy below said predetermined frequency, a second centre excited coupler for transferring $TE_{01}^{\frown}$ mode energy below a second predetermined frequency from two semi-circularly sectioned waveguides to $TE_{10}^{\square}$ mode energy in an axially, centrally disposed waveguide having a rectangular cross-section with the narrow walls thereof connected to the flat sides of the semi-circularly sectioned waveguides, said second predetermined frequency being below said first predetermined frequency, a reflection filter for permitting energy above said second predetermined frequency to pass substantially unaffected therethrough and for reflecting energy below said second predetermined frequency so as to provide an in-phase relationship between the $TE_{01}^{\frown}$ mode energy reflected thereby the energy then being capable of being coupled by the rectangularly sectioned waveguide of said second centre excited coupler, a third centre excited coupler for transferring $TE_{01}^{\frown}$ mode energy below a third predetermined frequency from two semi-circularly sectioned waveguides to $TE_{10}^{\frown}$ mode energy in an axially, centrally, disposed waveguide having a rectangular cross-section with the narrow walls thereof connected to the flat sides of the semi-circularly sectioned waveguides, said third predetermined frequency being above said second predetermined frequency but below said first predetermined frequency, a further reflection filter for permitting energy above said third predetermined frequency to pass substantially unaffected therethrough and for reflecting energy below said third predetermined frequency so as to provide an in-phase relationship between $TE_{01}^{\frown}$ mode energy reflected thereby, the energy then being capable of being coupled by the rectangular waveguide of said third centre excited coupler, and a fourth centre excited coupler for transferring $TE_{01}^{\frown}$ mode energy above said third predetermined frequency but below said first predetermined frequency from two semi-circularly sectioned waveguides to $TE_{10}$ mode energy in an axially, centrally disposed waveguide having a rectangular cross-section with the broad walls thereof connected to the flat sides of the semi-circular waveguides.

Preferably the reflection filter and the further reflection filter are each in accordance with our U.S. Pat. No. 3,851,282.

Because the highest and lowest sub-bands are attenuated the most by a transmission path, in some applications, for example a repeater station, expense is saved if only the required sub-bands are regenerated and amplified, or otherwise utilised.

Accordingly in a further aspect of this invention, a microwave band branching arrangement includes coupler means for coupling out for utilisation at least one sub-band of frequencies whilst permitting the remaining frequency sub-bands to pass through the arrangement substantially unaffected, and a further coupler means for recoupling the sub-band or sub-bands after utilisation to said remaining frequency bands.

Preferably the coupler means and the further coupler means are centre excited couplers each for selectively transferring $TE_{01}^{\frown}$ mode energy from two semi-circularly sectioned waveguides to $TE_{10}^{\sqcup}$ mode energy in an axially, centrally, disposed waveguide having a rectangular cross-section with the narrow walls thereof connected to the flat sides of the semi-circularly sectioned waveguides.

Where the band branching arrangement is for use in a repeater station preferably the arrangement is such that the highest and/or the lowest sub-band of frequencies are coupled out for utilisation. Preferably utilisation means are provided in the form of a regeneration and amplification means.

In a preferred embodiment a microwave band branching arrangement for use in a repeater station includes the sequential connection of a bifurcation for transferring $TE_{01}^{\bigcirc}$ mode energy at one end thereof from a circularly sectioned waveguide to a $TE_{01}^{\frown}$ mode into two semi-circularly sectioned waveguides at the other end thereof, a first centre excited coupler for coupling energy above a first predetermined frequency, a first phase shifter and low pass filter for permitting energy below said first predetermined frequency to pass therethrough with a phase shift governed by the phase shifter and arranged to reflect energy above said first predetermined frequency so that the $TE_{01}^{\frown}$ mode energy above said first predetermined frequency is reflected with an in-phase relationship for it to be coupled by the rectangularly sectioned waveguide of said first centre excited coupler, a further phase shifter for restoring the phase opposition relationship between the $TE_{01}^{\frown}$ mode energy below said first predetermined frequency, a second centre excited coupler for coupling frequencies below a second predetermined frequency which is below said first predetermined frequency, a reflection filter for permitting $TE_{01}^{\frown}$ energy above said second predetermined frequency to pass substantially unaffected therethrough and for reflecting energy below said second predetermined frequency so as to provide an in-phase relationship between the $TE_{01}^{\frown}$ mode energy reflected thereby for it to be coupled by the rectangularly sectioned waveguide of said second centre excited coupler, a third centre excited coupler also for coupling frequencies below said second predetermined frequency, a second phase shifter and low pass filter for permitting energy below said first predetermined frequency to pass therethrough with a phase shift governed by the phase shifter and arranged to reflect energy above said first predetermined frequency such that the $TE_{01}^{\frown}$ mode energy above said first predetermined frequency is reflected with an in-phase relationship for it to be coupled by the rectangularly sectioned waveguide of a fourth centre excited coupler.

In such a preferred embodiment advantageously isolation means with regard to the $TE_{01}^{\frown}$ mode energy below said second predetermined frequency in addition to said reflection filter are provided between the second and third centre excited couplers. The said isolation means may comprise two further centre excited couplers each for coupling energy below said first predetermined frequency and above said second predetermined frequency with a high pass filter for passing $TE_{10}^{\sqcup}$ mode energy above said second predetermined frequency connected between the rectangularly sectioned waveguides of the two further centre excited couplers, one of the two further centre excited couplers being connected to the reflection filter and the other of said two further centre excited couplers being connected to the third centre excited coupler through the intermediary of a further reflection filter also arranged to permit $TE_{01}^{\frown}$ energy above said second predetermined frequency to pass substantially unaffected therethrough.

Figure 2:
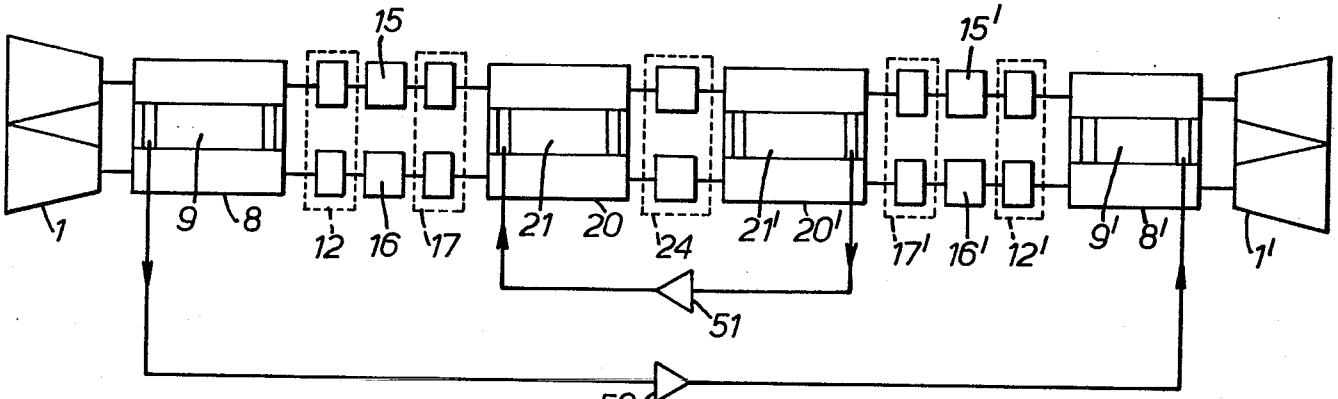
Figure 3:
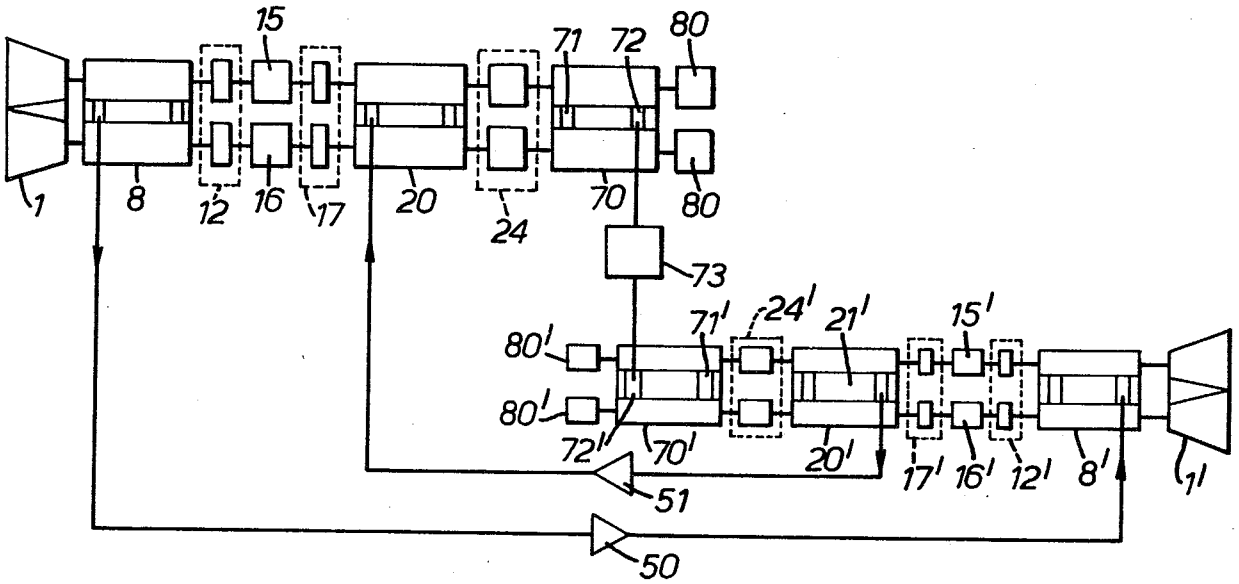

The invention will now be described, by way of example, with reference to the accompanying drawings in which FIG. 1 shows in schematic form a microwave band branching arrangement in accordance with one aspect of this invention, FIG. 2 shows in schematic form a microwave band branching arrangement in accordance with a further aspect of this invention for use in a repeater station where only the highest and lowest sub-band frequencies are to be amplified and regenerated, and FIG. 3 shows a different embodiment of the arrangement shown in FIG. 2 having increased isolation between the couplers where the energy is coupled out and reinserted into the arrangement.

In the figures like reference numerals denote like parts.

The microwave band branching arrangement shown in FIG. 1 has a bifurcation 1 with a circularly sectioned input port 2, a flat sided wedge portion 3, and is shaped so that two radii are maintained normally to each wedge surface, whereby the wedge portion 3 produces two semi-circular waveguides culminating in two semi-circularly sectioned output ports 4, 5. The ports 4, 5 are connected to two semi-circularly sectioned waveguides 6, 7 of a centre excited coupler 8 which is arranged to couple energy in the frequency band 90–110GHz. Axially and centrally disposed between the flat sides of the semi-circular waveguides 6, 7 of the coupler 8 is a rectangularly sectioned waveguide 9 having its narrow walls coupled to the semi-circularly sectioned waveguides 6, 7 by longitudinally disposed, axial, coupling slots (not shown). The slots are shaped and dimensioned in accordance with known principles to resonate at a frequency 25%, or more, higher than the highest frequency to be propagated by the semi-circularly sectioned waveguides 6, 7 and are equally spaced apart by $\lambda g/2$, where $\lambda g$ is the waveguide wavelength of a frequency 15%, or more, above the highest frequency to be propagated by the waveguides 6, 7. Waveguide 9 is provided with ports 10, 11, port 10 being the output coupling port and port 11 being terminated in a matched load (not shown). The semi-circularly sectioned waveguides 6, 7 are connected to a phase shifter 12 which is arranged such that the energy from the waveguide 6 is delayed by 90° in a waveguide member 13 relative to the energy from waveguide 7 which passes substantially unaffected through a waveguide member 14. The members 14, 13 are each connected to a low pass filter 15, 16 respectively which each has a cut-off frequency of 90GHz. Each of the low pass filters 15, 16 is connected to a further phase shifter 17 which is similar to the phase shifter 12 except that the waveguide members 13, 14 are connected in opposite energy paths so as to restore the phase relationship which existed between the paths prior to the phase shifter 12.

Output from the members 14, 13 of the phase shifter 17 is taken to a semi-circularly sectioned waveguide 18, 19 respectively, of a centre excited coupler 20 which is arranged to couple energy in a frequency band 30–50GHz from the semi-circularly sectioned waveguides 18, 19 to an axially, centrally disposed waveguide 21. The narrow walls of the waveguide 21 are connected to the flat sides of the semi-circularly sectioned waveguide 18, 19 which are each provided with two longitudinal internal, ridges spaced 0.546 along the radius of the waveguides 18, 19 and dimensioned to increase the potential bandwidth of the dominent $TE_{10}^{\frown}$ mode with respect to the $TE_{20}^{\frown}$ mode so that the cut-off frequency of the $TE_{20}^{\frown}$ mode is twice the cut-off frequency of the $TE_{10}^{\frown}$ mode. The rectangularly sectioned waveguide 21 has a coupling port 22 and a port 23 terminated in a matched load (not shown). A high pass reflection filter 24 of the type described in our U.S. Pat. No. 3,851,282 has channels 25, 26 which are connected to the semi-circularly sectioned waveguides 18, 19 and which are arranged to reflect energy below. 50GHz with a 180° phase shift therebetween, the energy above 50GHz being passed through the channels 25, 26 substantially unaffected. A centre excited coupler 27 having two semi-circularly sectioned waveguides 28, 29 connected to the channels 25, 26 is arranged to couple energy in the frequency band 50–70GHz to an axially, centrally, disposed rectangularly sectioned waveguide 30, the narrow walls of the rectangularly sectioned waveguide 30 being connected to the flat sides of the semi-circularly sectioned waveguides 28, 29. Output from the rectangularly sectioned waveguide 30 is taken from a coupling port 31 and a further port 32 of the rectangularly sectioned waveguide 30 is connected to a matched load (not shown). A further high pass filter 33, which is similar to the high pass filter 24 but has a cut-off frequency of 70GHz, has channels 34, 35 connected to a pair of semi-circularly sectioned waveguides 36, 37 respectively of a centre excited coupler 39. The coupler 39 is arranged to couple energy in the frequency band 70–90GHz to an axially, centrally, disposed rectangularly sectioned waveguide 40 having the broad walls thereof connected to the flat sides of the semi-circularly sectioned waveguides 36, 37. Waveguide 40, in contrast to the couplers 8, 20, 27 has an output coupling port 41 which is at the remote end of the coupler 39 from the bifurcation 1, and a port 42 which is connected to a matched load (not shown). The remote end of each of the semi-circularly sectioned waveguides 36, 37 is terminated in a matched load 43.

In operation, energy in the circularly sectioned waveguide in the frequency range 30–110GHz in the $TE_{01}^{\circ}$ mode is applied to the input port 2. The bifurcation 1 divides the $TE_{01}^{\circ}$ mode energy substantially equally into the $TE_{01}^{\frown}$ mode, operating in semi-circular section waveguide, without substantial reflection or disturbance. As will be apparent to those skilled in the art, the magnetic fields of the semi-circular axial electromagnetic waves entering the waveguide 6, 7 and propagated therealong are phase displaced by $\pi$ radians at the flat side of the semi-circularly sectioned waveguides 6, 7 adjacent rectangular waveguide 9. Because the electromagnetic waves are phase displaced there is substantially no coupling between waveguides 6, 7 and waveguide 9 so that substantially all the energy entering port 2 is propagated to the waveguide members 13, 14 of phase shifter 12. Energy entering the waveguide member 13 is provided with a 90° phase shift relative to the energy entering the waveguide member 14 and energy below the cut-off frequency (90GHz) of the low pass filters 15, 16 is passed to the phase shifter 17; the waveguide members 13, 14 of the phase shifter 17 being arranged in complementary channels to the waveguide members 13, 14 of the phase shifter 12 so that the $\pi$ radian phase relationship which existed between top and bottom (as viewed) semi-circularly sectioned channels prior to the phase shifter 12 is restored. However, the energy above the 90GHz cut-off frequency of the low pass filters 15, 16 is reflected back through the waveguide members 13, 14 of the phase shifter 12 so that the energy passing through the waveguide member 13 is again phase shifted by 90° so that the reflected energy in the top semi-circularly sectioned channel suffers a total of $\pi$ radians phase shift. Thus the energy reflected into the semi-circularly sectioned waveguide 6, 7 is now in an in-phase condition. Now that such an in-phase condition exists the reflected $TE_{01}^{\frown}$ mode energy in the highest sub-band frequency range (90–110GHz) is coupled into the rectangularly sectioned waveguide 9 operating in the $TE_{10}^{\square}$ mode and thence out of port 10 for utilisation. It will now be realised that the semi-circularly sectioned members 6, 7, 13, 14, 15, 16 are required to be oversize waveguides to permit propagation of energy in the lower sub-bands extending from 30–90GHz.

$TE_{01}^{\frown}$ mode energy entering the semi-circularly sectioned waveguides 18, 19 passes therethrough because of the aforementioned $\pi$ radian phase shift between the energies in the top and bottom semi-circularly sectioned waveguides and $TE_{01}^{\frown}$ mode energy above 50GHz passes substantially unaffected through the high pass filter 24. The $TE_{01}^{\frown}$ mode energy below 50GHz is reflected by the tapers of the channels 25, 26 back into the semi-circularly sectioned waveguides 18, 19 with an in-phase condition. Thus the $TE_{01}^{\frown}$ mode energy in the sub-band frequency range 30–50GHz is coupled into the rectangularly sectioned waveguide 21 operating in the $TE_{10}^{\square}$ mode and thence out of coupling port 22 for utilisation. By similar action $TE_{01}^{\frown}$ mode energy above 70GHz passes substantially unaffected through the channels 34, 35 of the reflection filter 33 and $TE_{01}^{\frown}$ mode energy below 70GHz (i.e. energy in the sub-band 50–70GHz) is reflected by the filter 33 with an in-phase relationship so that it is coupled into the rectangularly sectioned waveguide 30. Thus $TE_{10}^{\square}$ mode energy is coupled out of the coupling port 31 for utilisation.

The $TE_{01}^{\frown}$ mode energy in the remaining sub-band is coupled from the semi-circularly sectioned waveguides 36, 37 into the rectangularly sectioned waveguide 40 since it is a function of rectangular waveguide broad wall coupling that energy at opposite major faces which exhibits a $\pi$ radian phase shift is coupled, the coupled energy in the $TE_{10}^{\square}$ mode being taken from output coupling port 41 for utilisation.

The microwave band branching arrangement shown in FIG. 2 comprises the bifurcation 1, the centre excited coupler 8 for coupling energy in the sub-band 90–110GHz, the phase shifter 12, the low pass filters 15, 16, each having a cut-off frequency of 90GHz, the phase shifter 17, the centre excited coupler 20 for coupling energy in the sub-band 30–50GHz, and the reflection filter 24 having a cut-off frequency of 50GHz, as previously described with reference to FIG. 1. The arrangement is symmetrical about the reflection filter 24 and the components to the right hand side thereof (as viewed) are primed. An amplifier and regenerator 50 is connected to receive output from the centre excited coupler 8 and to reinsert the amplified and regenerated signals into the centre excited coupler 8'. Similarly, an amplifier and regenerator 51 is connected to receive output from the centre excited coupler 20' and to apply the amplified and regenerated signals to the centre excited coupler 20.

In operation, energy in the frequency band 30–110GHz in the $TE_{01}^{\bigcirc}$ mode is applied at the bifurcation 1. As previously described the energy divides substantially equally into $TE_{01}^{\frown}$ mode energy which is phase shifted by the phase shifter 12 and energy in the highest sub-band (90–110GHz) is reflected by the low pass filters 15, 16 so that the reflected energy is coupled into the rectangularly sectioned waveguide 9 of the centre excited coupler 8. Energy below the 90GHz cut-off frequency of the low pass filters 15, 16 is phase restored by the phase shifter 17 and passed to the high pass filter 24. Energy above the high pass filter 24 cut-off frequency (50GHz) passes substantially unaffected therethrough to re-emerge from the bifurcation 1' again in the $TE_{01}^{\bigcirc}$ mode. The $TE_{10}^{\square}$ mode energy in the highest sub-band (90–110GHz) is coupled out of the rectangularly sectioned waveguide 9 to be amplified and regenerated by the amplifier 50 and subsequently reinserted into the rectangularly sectioned waveguide 9' of the centre excited coupler 8, whereupon the highest sub-band energy is recombined with the 70–90GHz sub-band and transferred out of the bifurcation 1'.

$TE_{01}^{\bigcirc}$ mode energy in the frequency range 30–70GHz is divided substantially equally by the bifurcation 1' into $TE_{01}^{\frown}$ mode energy propagating in the semi-circularly sectioned waveguides of the coupler 8'. The energy in the top and bottom channels (as viewed) has the phase relationship thereof altered by the phase shifter 12', and phases substantially unaffected through the low pass filters 15', 16' whereupon the phase relationship between the top and bottom channels is restored by the phase shifter 17'. Because the $TE_{01}^{\frown}$ mode energy between the top and bottom channels is phase displaced by $\pi$ radians it passes through the centre excited coupler 20' to the reflection filter 24 whereupon energy above 50GHz, i.e. the sub-band 50–70GHz, passes substantially unaffected therethrough, and energy in the sub-band 30–50GHz is reflected with a $\pi$ radian phase displacement between the top and bottom channels so that it is coupled into the rectangularly sectioned waveguide 21' of the centre excited coupler 20'. Energy in the $TE_{10}^{\square}$ mode is thus coupled out of the rectangularly sectioned waveguide 21', amplified and regenerated by the amplifier and regenerator 51 and reinserted into the rectangularly sectioned waveguide 21 of the centre excited coupler 20. The $TE_{10}^{\square}$ mode energy in the waveguide 21 is coupled into the semi-circularly sectioned waveguides of the centre excited coupler 20 to be recombined with the 50–70GHz sub-band, and the recombined sub-bands are transferred to the $TE_{01}^{\bigcirc}$ mode by the bifurcation 1.

It will now be seen that energy in the top (90–110GHz) and bottom (30–50GHz) bands is coupled out, to be amplified and regenerated, whilst the mid sub-bands (50–70GHz and 70–90GHz) pass substantially unaffected through the arrangement, thus saving considerable expense by the omission of amplifiers and regenerators for the mid sub-bands.

In some applications of the band branching arrangement for a repeater station it is desirable that a greater isolation be provided between the centre excited couplers 20 and 20' to prevent the amplifed and regenerated energy in the 30–50GHz sub-band breaking through the high pass filter 24, thereby propagating in an undesired direction. Such an arrangement will now be described with reference to FIG. 3 in which a centre excited coupler 70 for coupling energy in the frequency range 50–90GHz has two semi-circularly sectioned waveguides and an axially, centrally disposed rectangular waveguide with the narrow walls of the rectangularly sectioned waveguide connected to the flat sides of the semi-circularly sectioned waveguides, the coupler 70 being connected to receive energy from the reflection filter 24. A port 71 of the rectangularly sectioned waveguide nearer the bifurcation 1 is terminated in a matched load (not shown) and a coupling port 72 of the rectangularly sectioned waveguide is connected via a high pass (or band-pass) filter 73 having a cut-off frequency of 50GHz to a coupling port 72' of a centre excited coupler 70', which coupler 70' is similar to the coupler 70. The coupler 70' is connected by the semi-circularly sectioned waveguides thereof through a reflection filter 24', which is similar to the reflection filter 24, to the centre excited coupler 20', the open, free, ends of the semi-circularly sectioned waveguides of the couplers 70, 70' being connected to matched loads 80, 80'. It will now be seen that energy in the lowest sub-band (30–50GHz) which attempts to be propagated in an undesired (reversed) direction must now break through the reflection filters 24, 24', the couplers 70, 70', and the high pass filter 73 before it can pass into the rectangularly sectioned waveguide 21' of the coupler 20' and so provide instability in the form of positive feedback.

Alternatively, instead of providing discrete components 70, 70', 73, 80, 80' it is possible to provide a centre excited coupler for coupling energy from the $TE_{01}^{\frown}$ mode to the $TE_{10}^{\square}$ mode in the frequency range 50–90GHz with a high pass filter having a cut-off frequency of 50GHz in the rectangularly sectioned waveguide thereof and a subsequent section of the coupler being capable of transferring the $TE_{10}^{\square}$ mode energy back into the $TE_{01}^{\frown}$ mode. Such a coupler has the narrow walls of the axially, centrally disposed waveguide connected to the flat sides of two semi-circularly sectioned waveguides and has the advantage that the arrangement for a repeater station has a single longitudinal axis and eliminates the requirement for the loads 80, 80'.

I claim:

1. A microwave band branching arrangement including the sequential connection of a bifurcation for transferring $TE_{01}^{\bigcirc}$ mode energy at one end thereof from a circularly sectioned waveguide to $TE_{01}^{\frown}$ mode energy in two semi-circularly sectioned waveguides at the other end thereof, the $TE_{01}^{\frown}$ mode energy in each of the semi-circular waveguides being in phase opposition, a first centre excited coupler for transferring the $TE_{01}^{\frown}$ mode energy above a first predetermined frequency from the said two semi-circularly sectioned waveguides to a $TE_{10}^{\square}$ mode in an axially, centrally disposed waveguide having a rectangular cross-section with the narrow walls thereof connected to the flat sides of the semi-circular waveguides, a phase shifter and a low pass filter for permitting energy below said first predetermined frequency to pass therethrough with a phase shift governed by the phase shifter and arranged to reflect $TE_{01}^{\frown}$ mode energy above said predetermined frequency such that the $TE_{01}^{\frown}$ mode energy above said predetermined frequency is reflected with an in-phase relationship so that it is capable of being coupled by the said rectangularly sectioned waveguide, a further phase shifter for restoring the phase opposition relationship between the $TE_{01}^{\frown}$ mode energy below said predetermined frequency, a second centre excited coupler for transferring $TE_{01}^{\frown}$ mode energy below a second predetermined frequency from two semi-circularly sectioned waveguides to a $TE_{10}^{\square}$ mode energy in an axially, centrally disposed waveguide having a rectangular cross-section with the narrow walls thereof connected to the flat sides of the semi-circularly sectioned waveguides, said second predetermined frequency being below said first predetermined frequency, a reflection filter for permitting energy above said second predetermined frequency to pass substantially unaffected therethrough and for reflecting energy below said second predetermined frequency so as to provide an in-phase relationship between the $TE_{01}^{\frown}$ mode energy reflected thereby the energy then being capable of being coupled by the rectangularly sectioned waveguide of said second centre excited coupler, a third centre excited coupler for transferring $TE_{01}^{\frown}$ mode energy below a third predetermined frequency from two semi-circularly sectioned waveguides to $TE_{10}^{\square}$ mode energy in an axially, centrally, disposed waveguide having a rectangular cross-section with the narrow walls thereof connected to the flat sides of the semi-circularly sectioned waveguides, said third predetermined frequency being above said second predetermined frequency but below said first predetermined frequency, a further reflection filter for permitting energy above said third predetermined frequency to pass substantially unaffected therethrough and for reflecting energy below said third predetermined frequency so as to provide an in-phase relationship between $TE_{01}^{\frown}$ mode energy reflected thereby, the energy then being capable of being coupled by the rectangular waveguide of said third centre excited coupler, and a fourth centre excited coupler for transferring $TE_{01}^{\frown}$ mode energy above said third predetermined frequency but below said first predetermined frequency from two semi-circulary sectioned waveguides to $TE_{10}^{\square}$ mode energy in an axially, centrally disposed waveguide having a rectangular cross-section with the broad walls thereof connected to the flat sides of the semi-circular waveguides.

2. A microwave band branching arrangement for use in a repeater station including the sequential connection of a bifurcation for transferring $TE_{01}^{\bigcirc}$ mode energy at one end thereof from a circularly sectioned waveguide to a $TE_{01}^{\frown}$ mode into two semi-circularly sectioned waveguides at the other end thereof, a first centre excited coupler for coupling energy above a first predetermined frequency, a first phase shifter and low pass filter for permitting energy below said first predetermined frequency to pass therethrough with a phase shift governed by the phase shifter and arranged to reflect energy above said first predetermined frequency so that the $TE_{01}^{\frown}$ mode energy above said first predetermined frequency is reflected with an in-phase relationship for it to be coupled by the rectangularly sectioned waveguide of said first centre excited coupler, a further phase shifter for restoring the phase opposition relationship between the $TE_{01}^{\frown}$ mode energy below said first predetermined frequency, a second centre excited coupler for coupling frequencies below a second predetermined frequency which is below said first predetermined frequency, a reflection filter for permitting $TE_{01}^{\frown}$ energy above said second predetermined frequency to pass substantially unaffected therethrough and for reflecting energy below said second predetermined frequency so as to provide an in-phase relationship between the $TE_{01}^{\frown}$ mode energy reflected thereby for it to be coupled by the rectangularly sectioned waveguide of said second centre excited coupler, a third centre excited coupler also for coupling frequencies below said second predetermined frequency, a second phase shifter and low pass filter for permitting energy below said first predetermined frequency to pass therethrough with a phase shift governed by the phase shifter and arranged to reflect energy above said first predetermined frequency such that the $TE_{01}^{\frown}$ mode energy above said first predetermined frequency is reflected with an in-phase relationship for it to be coupled by the rectangularly sectioned waveguide of a fourth centre excited coupler.

3. A microwave band branching arrangement as claimed in claim 2 wherein isolation means with regard to the $TE_{01}^{\frown}$ mode energy below said second predetermined frequency in addition to said reflection filter are provided between said second and third centre excited couplers.

4. A microwave band branching arrangement as claimed in claim 3 wherein said isolation means comprise two further centre excited couplers each for coupling energy below said first predetermined frequency and above said second predetermined frequency with a high pass filter for passing $TE_{10}^{\square}$ mode energy above said second predetermined frequency connected between the rectangularly sectioned waveguides of the two further centre excited couplers, one of the two further centre excited couplers being connected to the reflection filter and the other of said two further centre excited couplers being connected to the third centre excited coupler through the intermediary of a further reflection filter also arranged to permit $TE_{01}^{\frown}$ energy above said second predetermined frequency to pass substantially unaffected therethrough.

5. A microwave band branching arrangement for successively coupling out frequency sub-bands germane to a broad frequency band, comprising bifurcation means for dividing applied microwave energy into two parallel paths and a series of successive center excited coupler means for sequentially coupling out different frequency sub-bands of said energy, each coupler means comprising two outer waveguide sections, each forming part of one of said two parallel paths, and an inner waveguide section coupled with said outer waveguide sections and being provided for taking off the energy of a respective frequency sub-band, that one coupler means which is provided for coupling out the highest frequency sub-band being disposed directly behind said bifurcation means and ahead of the remaining coupler means, one of said parallel paths including a reflection low pass filter connected to one outer waveguide of said one coupler means and a 90° phase shifter connected to such filter, and the other parallel path including a second 90° phase shifter connected to the other outer waveguide section of said one coupler means and a second reflection low pass filter connected to said second phase shifter.

6. A microwave branching arrangement as defined in claim 5 wherein said outer waveguide sections are semi-circularly sectioned waveguides and said inner waveguide section is of rectangular cross-section with the narrow walls thereof connected to the flat sides of the semi-circularly sectioned waveguides.

7. A microwave branching arrangement comprising, in combination:

bifurcation means, having an input port receiving a broad frequency band of microwave energy and a pair of output ports, for dividing the energy received into two parallel paths in which the energy is in phase opposition;

coupler means connected to said output ports for coupling out a sub-band of frequencies within said broad band, which sub-band is the highest frequency band in said broad band, said coupling means comprising a center excited coupler having two outer waveguide sections respectively forming portions of said two paths and an inner waveguide section coupled to said outer waveguide sections for coupling out said sub-band when the frequencies in said two paths are in phase; and phase shifting and reflecting means for causing said outer waveguide sections to receive reflected energy which is in phase such that said sub-band is coupled out of said coupler means, said phase shifting and reflecting means comprising low pass filter means downstream of said coupler means in both of said paths for passing microwave energy below that frequency at the lower end of said sub-band and reflecting the energy in said sub-band back to said coupler means, and a 90° phase shifter in one of said paths between said coupler means and said filter means whereby said energy which is reflected in said paths reaches said coupler means in phase.

8. A microwave branching arrangement as defined in claim 7 including a further 90° phase shifter disposed in said other path downstream of said filter means for restoring said out of phase relation between the two paths.

* * * * *